US011037533B2

(12) United States Patent
Yamashita et al.

(10) Patent No.: US 11,037,533 B2
(45) Date of Patent: Jun. 15, 2021

(54) UPRIGHT KEYBOARD INSTRUMENT

(71) Applicant: KABUSHIKI KAISHA KAWAI GAKKI SEISAKUSHO, Hamamatsu (JP)

(72) Inventors: Mitsuo Yamashita, Hamamatsu (JP); Hikari Ichihara, Hamamatsu (JP)

(73) Assignee: KABUSHIKI KAISHA KAWAI GAKKI SEISAKUSHO, Hamamatsu (JP)

( * ) Notice: Subject to any disclaimer, the term of this patent is extended or adjusted under 35 U.S.C. 154(b) by 0 days.

(21) Appl. No.: 16/823,189

(22) Filed: Mar. 18, 2020

(65) Prior Publication Data

US 2020/0302899 A1 Sep. 24, 2020

(30) Foreign Application Priority Data

Mar. 20, 2019 (JP) ..... JP2019-052664

(51) Int. Cl.

| | |
|---|---|
| ***G10C 3/166*** | (2019.01) |
| ***G10C 3/12*** | (2006.01) |
| ***G10C 3/26*** | (2019.01) |
| ***G10C 3/161*** | (2019.01) |

(52) U.S. Cl.

CPC ..... *G10C 3/166* (2013.01); *G10C 3/12* (2013.01); *G10C 3/161* (2013.01); *G10C 3/26* (2013.01)

(58) Field of Classification Search

CPC ..... G10C 3/166; G10C 3/12; G10C 3/161; G10C 3/26

See application file for complete search history.

(56) References Cited

U.S. PATENT DOCUMENTS

| | | | | |
|---|---|---|---|---|
| 312,776 A * | 2/1885 | Wessell et al. | ..... | G10C 3/166 84/255 |
| 5,022,302 A * | 6/1991 | Guyon | ..... | G10C 3/166 84/255 |
| 7,718,872 B2 * | 5/2010 | Bafunno | ..... | G10C 3/12 84/240 |
| 2020/0302899 A1 * | 9/2020 | Yamashita | ..... | G10C 3/161 |

FOREIGN PATENT DOCUMENTS

JP 2004-177434 6/2004

* cited by examiner

*Primary Examiner* — Robert W Horn

(74) *Attorney, Agent, or Firm* — Lewis Roca Rothgerber Christie LLP

(57) ABSTRACT

An upright keyboard instrument reduced in depth dimension and compact as a whole. Damper levers each extend in a vertical direction and are pivotally movably supported at or in the vicinity of a longitudinal center thereof, in a side-by-side arrangement in a left-right direction at a location rearward of actions. A damper rod extends in a left-right direction. A pedal rod extends in the vertical direction and is disposed forward of the damper levers, so as to be moved upward by depression of a pedal. A damper lever drive mechanism is provided between a longitudinal end of the damper rod and an upper end of the pedal rod and drives lower portions of the damper levers such that the lower portions are pressed rearward by moving the damper rod rearward in accordance with upward movement of the pedal rod.

5 Claims, 5 Drawing Sheets

UPRIGHT KEYBOARD INSTRUMENT

CROSS-REFERENCE TO RELATED APPLICATION(S)

This application claims priority to Japanese Patent Application Number 2019/052664, filed on Mar. 20, 2019, the entire contents of which are incorporated herein by reference.

BACKGROUND OF THE INVENTION

Field of the Invention

The present invention relates to an upright keyboard instrument which is applied e.g. to an upright acoustic piano or an upright electronic piano and is provided with not only a plurality of keys and actions, but also damper levers associated with the respective actions.

Description of the Related Art

Conventionally, as an upright keyboard instrument of the above-mentioned type, there has been known one disclosed e.g. in Japanese Laid-Open Patent Publication (Kokai) No. 2004-177434. This keyboard instrument is an electronic piano provided with a plurality of keys, actions, hammers, and dampers, and when a key is depressed, an action associated with the key is operated to drive a hammer and a damper each associated with the action. Note that this electronic piano is not provided with strings, and a tone is generated only by an electronic tone generator. Therefore, since it is not required to strike a string by a hammer or to hold the same by a damper, a hammer felt and a damper felt are omitted from the hammer and the damper, respectively.

Further, the electronic piano is provided with a damper pedal similar to that of an acoustic piano, and with the arrangement, described below, of a damper and component parts therearound, all the dampers are operated by depression of the damper pedal similarly to the dampers of the acoustic piano.

More specifically, each of the dampers has a damper lever extending vertically and configured to be pivotally movable about a portion thereof approximately central in the longitudinal direction thereof, and the damper levers are arranged side by side in the left-right direction. Further, there is provided a damper rod which extends in the left-right direction along the whole array of the damper levers, in a state held in contact with the lower portions of the front surfaces of the respective damper levers, and is configured to be pivotally movable rearward. The damper rod has one end thereof provided with a rod lever extending rearward, and an upper end of a pedal rod extending vertically is engaged with a tip end of the rod lever. With this arrangement, when the pedal rod is moved upward by depression of the damper pedal to push up the rod lever, the damper rod pivotally is moved rearward in accordance with this movement of the rod lever to press the lower portions of all the respective damper levers rearward. This causes, in the electronic piano, all the damper levers to pivotally move through a predetermined angle, whereby an operation similar to the operation of all the dampers of an acoustic piano moving in unison away from respective associated strings can be achieved.

As described above, in the electronic piano, the pedal rod configured to be moved upward by depression of the damper pedal is disposed rearward of the damper lever so as to push up the rod lever extending rearward from the damper rod. For this reason, in the case of the above-described electronic piano, it is required to secure space for disposing the pedal rod at a location rearward of the damper levers within the casing of the electronic piano, and therefore the depth dimension of the electronic piano is inevitably increased by an amount corresponding to the space.

SUMMARY OF THE INVENTION

It is an object of the present invention to provide an upright keyboard instrument which makes it possible to reduce the depth dimension of the keyboard instrument while securing predetermined operation of all damper levers caused by a pedal rod, to thereby make the keyboard instrument compact as a whole.

To attain the above object, the present invention provides an upright keyboard instrument in which a plurality of keys and actions associated with the respective keys are arranged side by side in a left-right direction, comprising a plurality of damper levers each of which extends in a vertical direction and is pivotally movably supported at or in the vicinity of a longitudinal center thereof, the damper levers being provided in association with the actions, respectively, and arranged side by side in the left-right direction at a location rearward of the actions, a damper rod which extends in the left-right direction and is supported in a manner movable in a front-rear direction in a state brought into contact with lower portions of the respective damper levers from a front side, a pedal rod which extends in the vertical direction and is disposed forward of the damper levers, the pedal rod being configured to be moved upward by depression of a pedal, and a damper lever drive mechanism which is provided between a longitudinal end of the damper rod and an upper end of the pedal rod and is configured to drive the lower portions of the respective damper levers such that the lower portions of the respective damper levers are pressed rearward by moving the damper rod rearward in accordance with upward movement of the pedal rod.

With this construction, when the pedal rod is moved upward by depression of the pedal, the damper lever drive mechanism operates to drive the lower portions of the respective damper levers such that the lower portions of the respective damper levers are pressed rearward by moving the damper rod rearward. This makes it possible to pivotally move all the damper levers through a predetermined angle. Therefore, in a case where the upright keyboard instrument is an acoustic piano having strings, it is possible to move the dampers retaining the strings in a key-released state away from the strings in unison by pedal operation. On the other hand, when the upright keyboard instrument is an electronic piano having no strings, it is possible to cause all the damper levers to perform the same operation as performed by the damper levers of the acoustic piano.

Further, differently from the conventional pedal rod, the pedal rod that is moved upward by depression of the pedal is disposed forward of the damper lever, and hence it is not required to secure space for the pedal rod at a location rearward of the damper levers. Therefore, according to the present invention, it is possible to make the depth dimension of the keyboard instrument shorter than that of the conventional upright keyboard instrument and thereby obtain the upright keyboard instrument made compact as a whole.

Preferably, the damper rod is configured to be pivotally movable about a pivotal portion located thereabove between a standby position where the damper rod is positioned when the pedal is in a non-operated state and a pressing position for pressing the damper levers rearward, and has a rod lever provided at a longitudinal end thereof and extending downward over a predetermined length, and the damper lever drive mechanism includes a pressing member which is in contact with a front surface of the rod lever and in engagement with the upper end of the pedal rod and is configured to press the rod lever rearward, and a pivotal movement support configured to pivotally support the pressing member.

With the construction of this preferred embodiment, the damper rod is configured to be pivotally movable about the pivotal portion located thereabove between the standby position and the pressing position, and has a rod lever provided at a longitudinal end thereof and extending downward over a predetermined length. Further, the damper lever drive mechanism includes the pressing member and the pivotal movement support, and when the pressing member is pushed up by the pedal rod, the pressing member supported by the pivotal movement support is pivotally moved to press the front surface of the rod lever rearward. This causes the damper rod to press the lower portions of the respective damper levers rearward while pivotally moving from the standby position to the pressing position. Thus, by using the damper rod and the damper lever drive mechanism each having a relatively simple construction, it is possible to cause all the damper levers to perform predetermined operation, by upward movement of the pedal rod disposed forward of the damper levers.

More preferably, the pressing member includes a contact portion which extends in the front-rear direction over a predetermined length and has a rear end thereof held in contact with the front surface of the rod lever, a pivotally movable portion which extends below the rod lever in the front-rear direction over a predetermined length, and has a front end thereof, which is located forward of the pivotal portion, held in engagement with the upper end of the pedal rod, and a rear end thereof, which is located rearward of the pivotal portion, supported by the pivotal movement support such that the pivotally movable portion is pivotally movable about an axis extending in the left-right direction, and a connection portion which connects between a front end of the contact portion and the front end of the pivotally movable portion.

With the construction of this preferred embodiment, the pressing member is formed to have a general C-shape, by the contact portion, the pivotally movable portion, and the connection portion, and the pivotally movable portion extending in the front-rear direction over the predetermined length has the front end thereof engaged with the upper end of the pedal rod, and the front end is located forward of the pivotal portion about which the damper rod pivotally moves. Further, the pivotally movable portion has the rear end thereof pivotally supported by the pivotal movement support, and the rear end is located rearward of the pivotal portion of the damper rod. The rear and front ends of the pivotally movable portion and the rear end of the contact portion function as a fulcrum, a force-applied point, and an action point, respectively, when the pressing member is pushed up by the pedal rod, and the rear end of the contact portion as the action point is moved obliquely rearward and upward to press the rod lever rearward. This makes it possible to pivotally move the damper rod stably rearward to the pressing position while properly transmitting a thrust force by the pedal rod to the rod lever. As a consequence, it is possible to cause all the damper levers to stably perform the predetermined operation.

Further preferably, the contact portion is configured such that the rear end thereof to be brought into contact with the rod lever is movable in the front-rear direction.

Due to an assembly error during manufacturing of a keyboard instrument or the like, in a key-released state of the keyboard instrument, there sometimes occurs a case in which a gap is formed between the rod lever of the damper rod and the contact portion of the pressing member or the contact portion is brought into strong contact with the rod lever. To eliminate this inconvenience, with the above construction, in the above-mentioned case, by moving the rear end of the contact portion in the front-rear direction for adjustment, it is possible to bring the contact portion of the pressing member into appropriate contact with the rod lever in the key-released state.

Even more preferably, the contact portion includes a support portion which extends in the front-rear direction over a predetermined length and is continuous with the connection portion, and a contact portion body which extends in the front-rear direction over a predetermined length and is configured to be movable in the front-rear direction in a state placed on the support portion, the contact portion body being fixed to the support portion, in a state protruding rearward of the support portion.

With the construction of this preferred embodiment, the contact portion of the pressing member has the support portion and the contact portion body, and by moving the contact portion body on the support portion in the front-rear direction and thereby fixing the same to an appropriate position, it is possible to easily obtain the same advantageous effects as provided by the above preferred embodiments.

The above and other objects, features, and advantages of the present invention will become more apparent from the following detailed description taken in conjunction with the accompanying drawings.

BRIEF DESCRIPTION OF THE DRAWINGS

FIGS. 3A and 3B are views useful in explaining operation of a damper lever, a damper rod, and a damper lever drive mechanism, in which FIG. 3A shows a state before the upward movement of a pedal rod, and FIG. 3B shows a state after the upward movement of the pedal rod.

FIGS. 5A and 5B are views showing a second variation of the damper lever drive mechanism, in which FIG. 5A shows a contact portion body in plan view, and FIG. 5B shows the contact portion body and a support portion in an exploded state.

FIGS. 6A and 6B are views useful in explaining work for adjusting the contact portion body shown in FIGS. 5A and 5B, in which FIG. 6A shows a state in which the contact portion body is most forwardly positioned, and FIG. 6B shows a state in which the contact portion body is most rearwardly positioned.

DETAILED DESCRIPTION OF PREFERRED EMBODIMENTS

Figure 1:
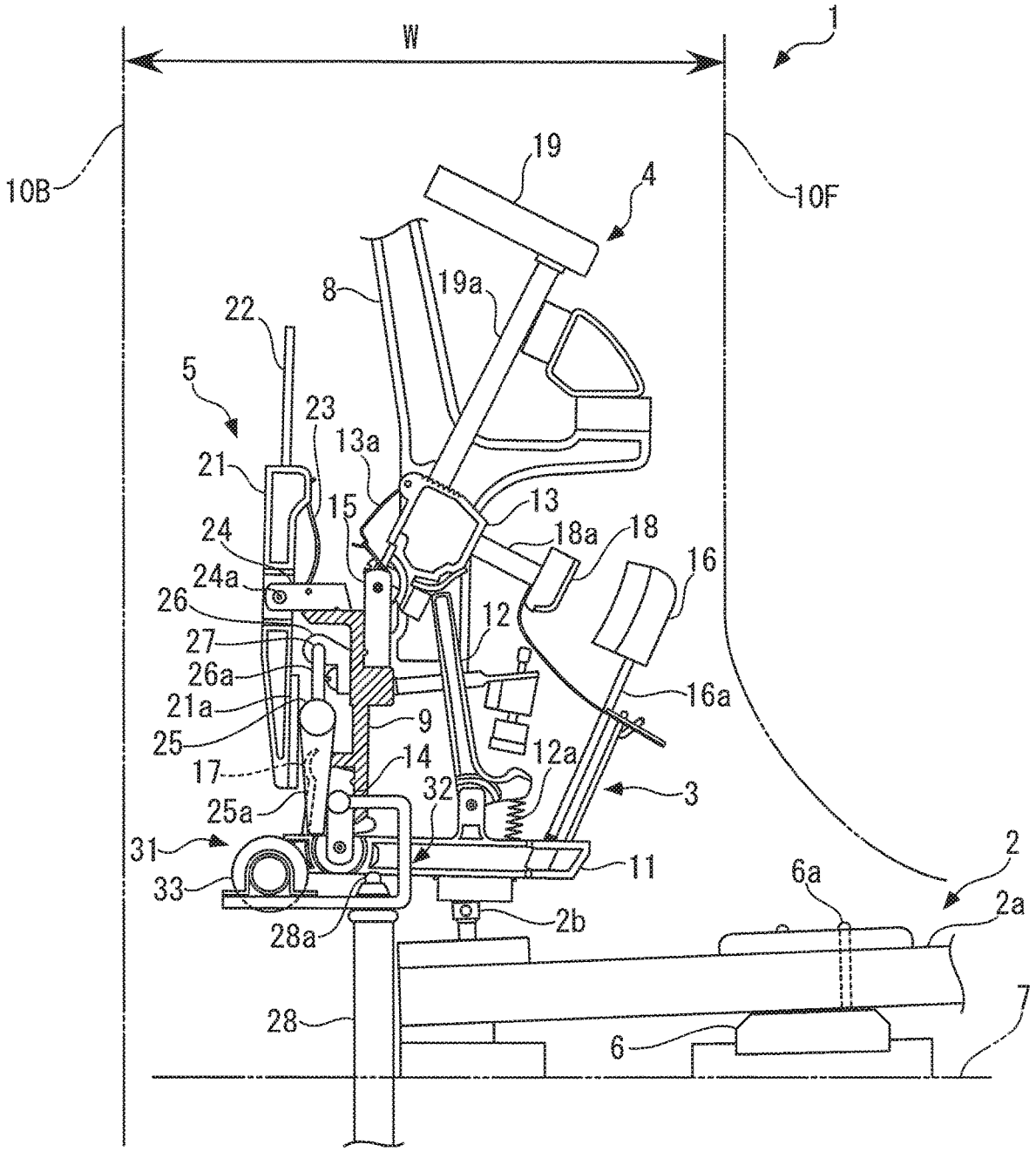
FIG. 1 is a side view showing an action and component parts therearound of an electronic piano, in a key-released state, to which is applied an upright keyboard instrument according to an embodiment of the present invention.

The present invention will now be described in detail with reference to the drawings showing preferred embodiments thereof. FIG. 1 shows an action and component parts therearound in an electronic piano, in a key-released state, to which is applied an upright keyboard instrument according to an embodiment of the present invention. Note that in the following description, a near side (right side as viewed in FIG. 1) and a far side (left side as viewed in FIG. 1), as viewed from a player, of the piano will be referred to as "front" and "rear", respectively.

As shown in FIG. 1, substantially similar to an upright acoustic piano (hereinafter simply referred to as "the upright piano"), the electronic piano 1 is provided with a keyboard 2 and a plurality of actions 3, a plurality of hammers 4, and a plurality of dampers 5 (only one of which is shown for each), and when a key 2*a* is depressed to thereby cause an action 3 associated with the key 2*a* to operate, a hammer 3 and a damper 5 each associated with the action 3 are driven. Note that although differently from the upright piano, the electronic piano 1 is not provided with strings to be struck by respective hammers and retained by respective dampers, the hammers 4 and the dampers 5 are configured to perform approximately the same operations as those in the upright piano.

The keyboard 2 has a plurality of keys 2*a* (only one of which is shown in FIG. 1) arranged side by side in a left-right direction. Each of the keys 2*a* extends in a front-rear direction and has a portion thereof close to the center thereof pivotally supported by a balance rail pin 6*a* erected on a keyframe 6. Note that the keyframe 6 is placed on a keybed 7 disposed at a location close to the center of the electronic piano 1 in a vertical direction.

On the keybed 7, there is disposed a center rail 9 via a plurality of brackets 8 (only one of which is shown in FIG. 1) arranged side by side in the left-right direction. The center rail 9 has a predetermined shape in cross section and extends in the left-right direction over the whole length of the keyboard 2.

Each of the actions 3 is constructed similar to an action of a general upright piano and disposed above a rear end of the keyboard 2. The action 3 includes a wippen 11, a jack 12, and a butt 13 each provided in association with an associated one of the keys 2*a*, and the wippen 11 and the butt 13 are pivotally supported, respectively, by a wippen flange 14 and a butt flange 15 which are mounted to the center rail 9. The wippen 11 is placed on a capstan 2*b* provided on a rear end of the key 2*a*. On a front end of the upper surface of the wippen 11, there is erected a back check wire 16*a*, and a back check 16 is attached to an upper end of the back check wire 16*a*. On the other hand, on a rear end of the upper surface of the wippen 11, there is erected a spoon 17 which can come into contact with a lower end of a front surface of a damper lever 21, referred to hereinafter, of the damper 5.

The jack 12 is pivotally mounted to the wippen 11 and is held in engagement with the butt 13 from below in the key-released state. Further, between the jack 12 and the wippen 11, there is provided a jack spring 12*a*. The butt 13 is urged by a butt spring 13*a* in a clockwise direction, as viewed in FIG. 1. Furthermore, on a front surface of the butt 13, there is provided a catcher shank 18*a* extending forward, and a catcher 18 is mounted on a front end of the catcher shank 18*a*.

The hammer 4 has a hammer shank 19*a* extending upward from the butt 13 over a predetermined length and a hammer head 19 mounted on an upper end of the hammer shank 19*a* and extending rearward. Note that since the electronic piano 1 is not provided with any strings as mentioned hereinbefore, the above-mentioned hammer head 19 is provided not for striking a string, but it is configured to have approximately the same weight as that of a general hammer head of the upright piano.

The damper 5 is disposed rearward of the center rail 9. The damper 5 has the damper lever 21 extending vertically and a damper wire 22 erected on an upper end surface of the damper lever 21. Note that the damper 5 is not required to retain a string, and hence differently from a general damper of the upright piano, no damper head is mounted on an upper end of the damper wire 22.

The damper 5 is supported by a damper flange 24 mounted to the center rail 9 at or in the vicinity of a longitudinal center of the damper lever 21 such that the damper 5 is pivotally movable about a pin 24*a* (axis) extending in the left-right direction. Further, the damper 5 is urged by a damper lever spring 23 in a counterclockwise direction as viewed in FIG. 1. Furthermore, on a lower portion of the front surface of the damper lever 21, there is provided a damper lever cloth 21*a*, and the damper lever cloth 21*a* is opposed, with a slight gap, to an upper end of the spoon 17 erected on the rear end of the upper surface of the wippen 11. Note that during depression of the key 2*a*, the spoon 17 provided on the wippen 11 of the action 3 associated with the key 2*a* presses the lower portion of the front surface of the damper lever 21, whereby the damper lever 21 is pivotally moved clockwise through a predetermined angle.

Figure 2:
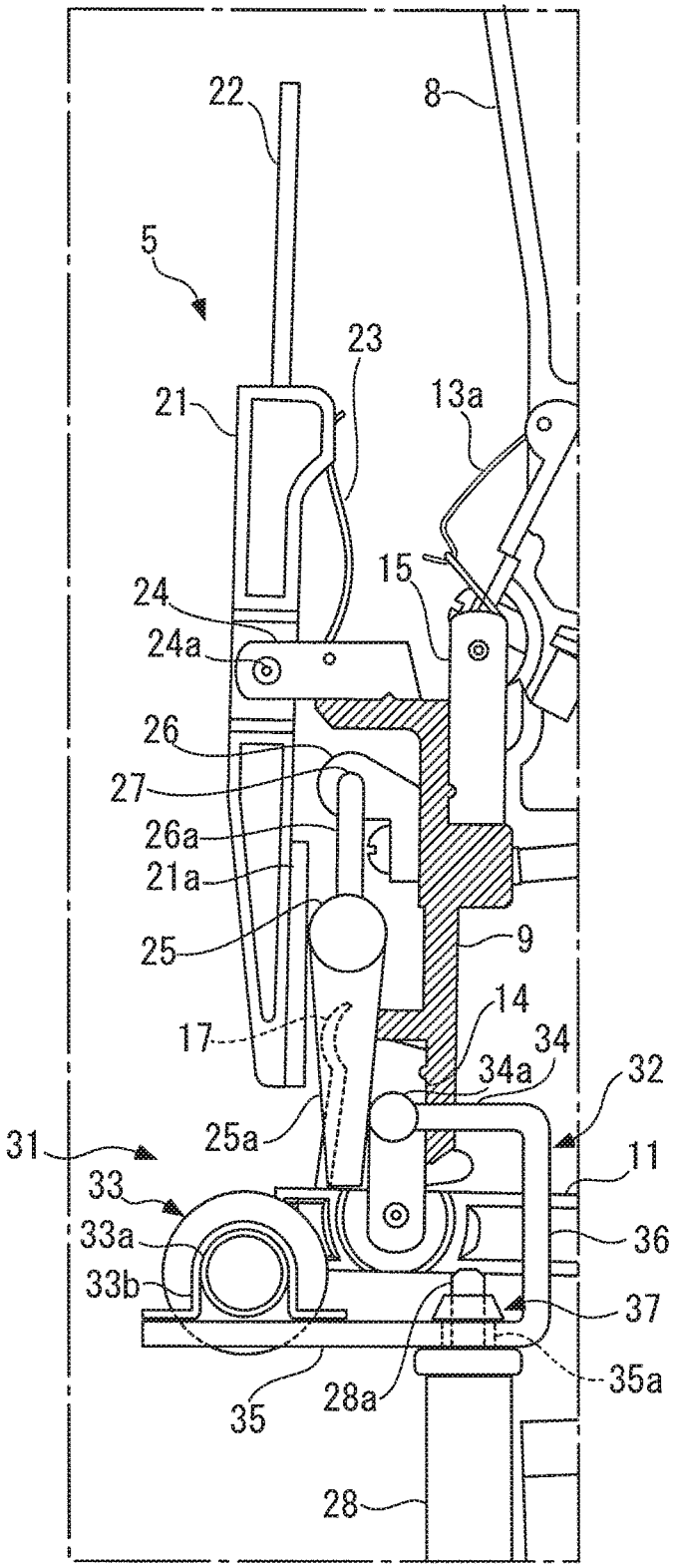
FIG. 2 is an enlarged view of a damper and component parts therearound appearing in the FIG. 1 side view.

FIG. 2 shows the damper 5 and component parts therearound on an enlarged scale. As shown in FIG. 2, between a lower portion of the damper lever 21 and the center rail 9, there is provided a damper rod 25 for pivotally moving all the dampers 5 in the clockwise direction as viewed in FIG. 2. The damper rod 25 is formed by a metal round rod having a predetermined diameter, and extends in the left-right direction along the whole array of the dampers 5 in a state held in contact with the lower portion (i.e. the damper lever cloth 21*a*) of the damper lever 21 from the front side. Further, the damper rod 25 is connected to a lower end of a vertically extending connection arm 26*a* of a damper rod hinge 26 attached to the center rail 9. Thus, the damper rod 25 is supported by the damper rod hinge 26 in a manner pivotally movable about an upper end (hereinafter referred to as "the pivotal portion 27") of the connection arm 26*a* between a standby position (see FIGS. 2 and 3A) where the damper rod 25 is positioned when a damper pedal, referred to hereinafter, is in a non-operated state and a pressing position (see FIG. 3B) for pressing the damper lever 21 rearward.

Further, a longitudinal end (left end in the present embodiment) of the damper rod 25 is integrally formed with a rod lever 25*a* extending downward over a predetermined length. Below the rod lever 25*a*, there is provided a damper lever drive mechanism 31 for driving the damper levers 21 of all the respective dampers 5 in unison via the damper rod 25. The damper lever drive mechanism 31 is actuated by a pedal rod 28 which is moved upward by depression of a damper pedal (hereinafter simply referred to as "the pedal"), not shown, constructed similar to a general damper pedal of the upright piano.

As shown in FIG. 2, the damper lever drive mechanism 31 is comprised of a pressing member 32 for pressing the rod lever 25*a* of the damper rod 25 and a pivotal movement support 33 for pivotally supporting the pressing member 32. The pressing member 32, which has a general C-shape in side view, is formed by an contact portion 34 extending in the front-rear direction over a predetermined length and having a rear end 34*a* formed in a general spherical shape for contact with a lower portion of a front surface of the rod lever 25*a*, a pivotally movable portion 35 extending in the front-rear direction over a predetermined length and having a rear end mounted to the pivotal movement support 33, and a connection portion 36 connecting between a front end of the contact portion 34 and a front end of the pivotally movable portion 35. Further, the front end of the pivotally movable portion 35 of the pressing member 32 is formed with a through hole 35*a*, and a cylindrical bush 37 made e.g. of rubber and having a predetermined shape is mounted over the through hole 35*a*. A protrusion shaft 28*a* protruding upward from a surface of an upper end of the pedal rod 28 over a predetermined length is inserted through the through hole 35*a* from below the bush 37.

On the other hand, the pivotal movement support 33 is comprised of a rotor portion 33*a* rotatable within a predetermined angle range and a mounting plate 33*b* fixed to the rotor portion 33*a* and mounted on a rear end of an upper surface of the pivotally movable portion 35 of the pressing member 32.

In the damper lever drive mechanism 31 constructed as above, the contact portion 34 and the pivotally movable portion 35 of the pressing member 32 and the rotor portion 33*a* of the pivotal movement support 33 are set to have such a positional relationship with the damper rod 25 as follows: In the contact portion 34 of the pressing member 32, the rear end 34*a* is held in contact with the front surface of the rod lever 25*a* of the damper rod 25, the front end of the pivotally movable portion 35 of the pressing member 32, which is engaged with the pedal rod 28, is located forward of the damper rod 25 and the pivotal portion 27 about which the damper rod 25 is pivotally moved, and further the center of the rotor portion 33*a* of the pivotal movement support 33 is located rearward of the damper rod 25 and the pivotal portion 27.

Figure 3A:
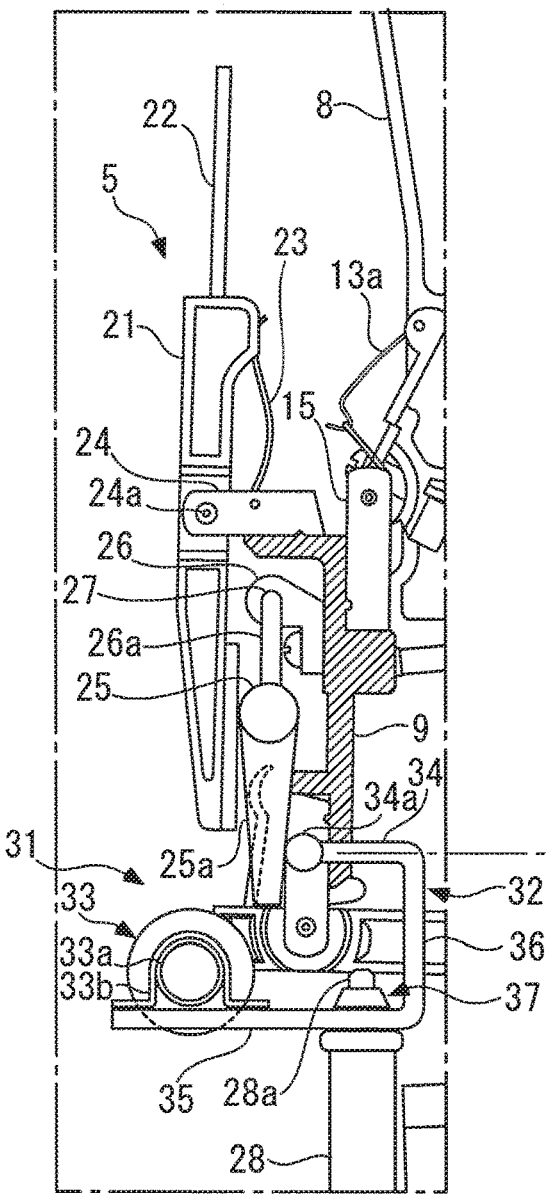
Figure 3B:
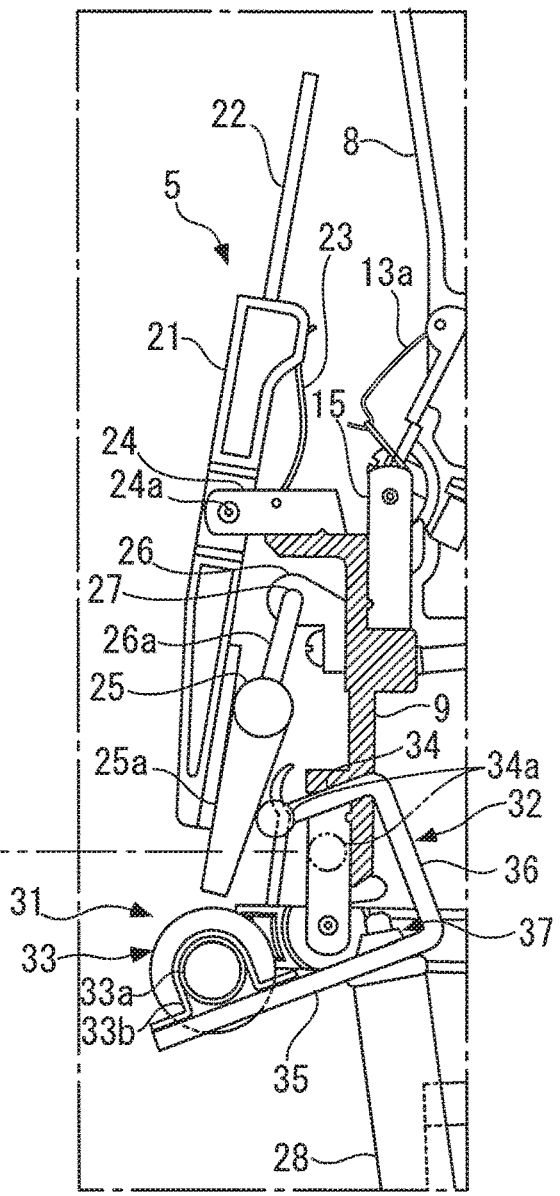

FIGS. 3A and 3B show respective states before and after the upward movement of the pedal rod 28. In the state shown in FIG. 3A, the damper rod 25 is positioned in the standby position, as in FIGS. 1 and 2, and the damper lever 21 of the damper 5 is in a posture substantially upright along a vertical line. When the pedal is depressed in this state, the pedal rod 28 is moved upward a predetermined height, and the front end of the pivotally movable portion 35 of the pressing member 32 is pushed up in accordance with the upward movement of the pedal rod 28. This causes the pressing member 32 to pivotally move about the rotor portion 33*a* of the pivotal movement support 33 through a predetermined angle in a counterclockwise direction as shown in FIG. 3B. In this case, the rear end 34*a* of the contact portion 34 of the pressing member 32 presses the rod lever 25*a* rearward as it moves obliquely rearward and upward. As a consequence, the damper rod 25 is pivotally moved from the standby position to the pressing position shown in FIG. 3B, and in accordance with this pivotal motion, the lower portion of the damper lever 21 is pressed by the damper rod 25 from the front side, whereby all the damper levers 21 are pivotally moved through a predetermined angle in the clockwise direction.

As described above in detail, according to the present embodiment, when the pedal rod 28 is moved upward by depression of the pedal, the damper lever drive mechanism 31 operates to press the lower portions of the respective damper levers 21 rearward by pivotally moving the damper rod 25 rearward. This makes it possible to pivotally move all the damper levers 21 through the predetermined angle. Thus, in the electronic piano 1, it is possible to cause the damper levers 21 of all the dampers 5 to perform the same operation as in the upright piano.

Further, since the pedal rod 28 that is moved upward by depression of the pedal is disposed forward of the damper lever 21 differently from the conventional pedal rod, it is not required to secure space for the pedal rod 28 at a location rearward of the damper lever 21. Therefore, according to the present embodiment, it is possible to make the depth dimension of the keyboard instrument, or specifically a distance W between an upper panel 10F and a rear panel 10B of the electronic piano 1 in FIG. 1, shorter than that of the conventional upright keyboard instrument, to thereby obtain the electronic piano 1 made compact as a whole.

Furthermore, in the damper lever drive mechanism 31, the rear and front ends of the pivotally movable portion 35 of the pressing member 32 and the rear end 34*a* of the contact portion 34 of the same function as a fulcrum, a force-applied point, and an action point, respectively, when the pressing member 32 is pushed up by the pedal rod 28, and the rear end 34*a* of the contact portion 34 as the action point is moved obliquely rearward and upward to press the rod lever 25*a* rearward. This makes it possible to pivotally move the damper rod 25 stably to the pressing position located rearward while properly transmitting a thrust force by the pedal rod 28 to the rod lever 25*a*. As a consequence, it is possible to cause all the damper levers 21 to stably perform the predetermined operation.

Figure 4A:
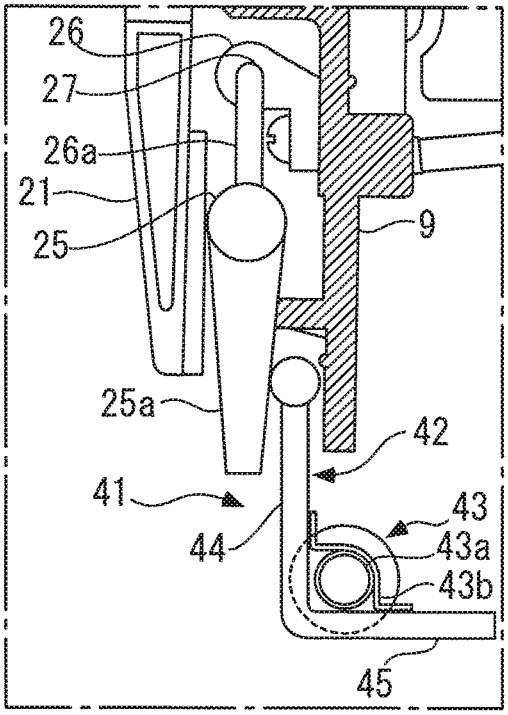
FIGS. 4A and 4B are views showing a first variation of the damper lever drive mechanism.
Figure 4B:
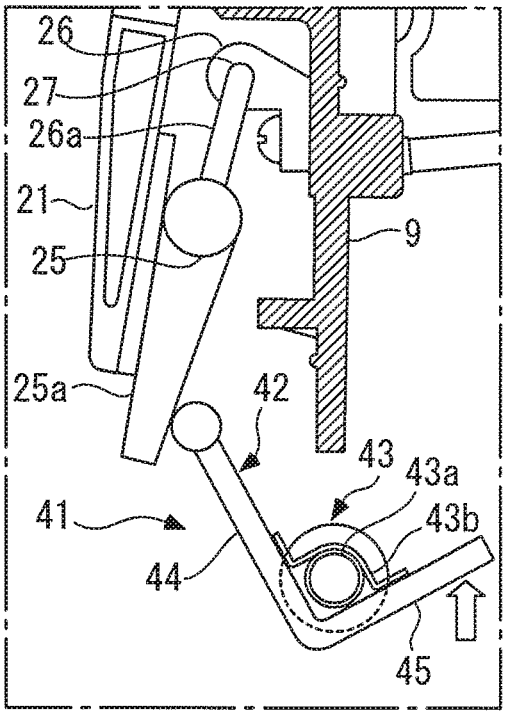

FIG. 4A shows a first variation of the damper lever drive mechanism 31. This damper lever drive mechanism 41 is distinguished from the damper lever drive mechanism 31 only by the shape of a pressing member 42 and the location of a pivotal movement support 43.

More specifically, in the damper lever drive mechanism 41 shown in FIG. 4A, the pressing member 42, which has an L shape in side view, is formed by a contact portion 44 extending in the vertical direction over a predetermined length and a pivotally movable portion 45 continuous with a lower end of the contact portion 44 and extending forward. Further, the pivotal movement support 43 constructed substantially similar to the pivotal movement support 33 has a rotor portion 43*a* thereof disposed inside a junction of the contact portion 44 and the pivotally movable portion 45 of the pressing member 42, and the contact portion 44 and the pivotally movable portion 45 are fixed to the rotor portion 43*a* via a mounting plate 43*b*. A pedal rod, not shown, is engaged with a front end of the pivotally movable portion 45, similar to the pressing member 32 of the damper lever drive mechanism 31.

Similar to the embodiment described hereinbefore, in the damper lever drive mechanism 41 constructed as above, when the front end of the pivotally movable portion 45 of the pressing member 42 is pushed up by the pedal rod, the pressing member 42 is pivotally moved about the rotor portion 43*a* of the pivotal movement support 43 through a predetermined angle in the counterclockwise direction to thereby press the rod lever 25*a* rearward. As a consequence, the damper rod 25 is pivotally moved from the standby position rearward to the pressing position, and in accordance with this pivotal motion of the damper rod 25, the lower portion of the damper lever 21 is pressed by the damper rod 25 from the front side, whereby all the damper levers 21 are pivotally moved clockwise through a predetermined angle.

Figure 5A:
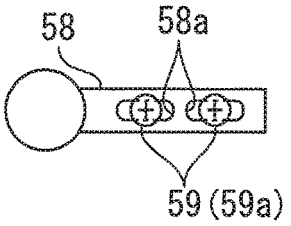
Figure 5B:
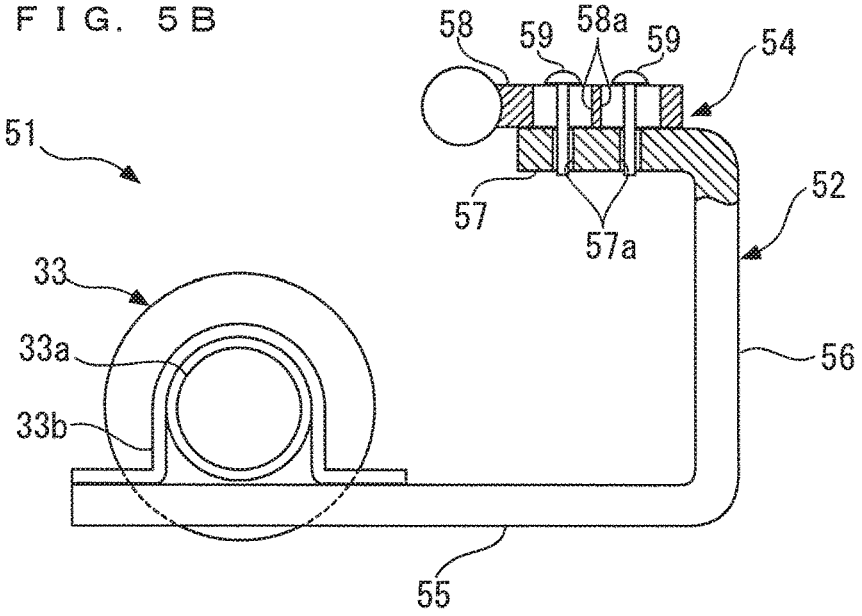

FIGS. 5A and 5B show a second variation of the damper lever drive mechanism 31. This damper lever drive mechanism 51 is distinguished from the damper lever drive mechanism 31 described hereinbefore only by the structure of a contact portion 54 of a pressing member 52.

More specifically, in the damper lever drive mechanism 51 shown in FIG. 5B, the contact portion 54 of the pressing member 52 is comprised of a support portion 57 extending in the front-rear direction over a predetermined length and continuous with a connection portion 56, and a contact portion body 58 screwed to the support portion 57 in a state placed on an upper surface of the support portion 57 such that the contact portion body 58 is movable in the front-rear direction. The support portion 57 is formed with two screw holes 57*a* and 57*a* arranged in the front-rear direction with a predetermined distance therebetween. On the other hand, the contact portion body 58 extends in the front-rear direction over a predetermined length and has a rear end thereof formed in a spherical shape. Further, the contact portion body 58 is formed with two slots 58*a* and 58*a* each elongated in the front-rear direction and arranged in the front-rear direction with a predetermined distance therebetween. The slots 58*a* and 58*a* of the contact portion body 58 are aligned with the screw holes 57*a* and 57*a* of the support portion 57, respectively, and in this state, two screws 59 and 59 are inserted through the respective slots 58*a* and screwed into the respective associated screw holes 57*a*, whereby the contact portion body 58 is fixed to the support portion 57 in a state pressed downward by head portions 59*a* of the respective screws 59.

Figure 6A:
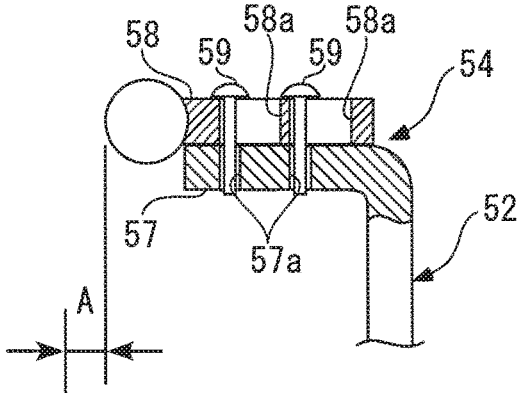
Figure 6B:
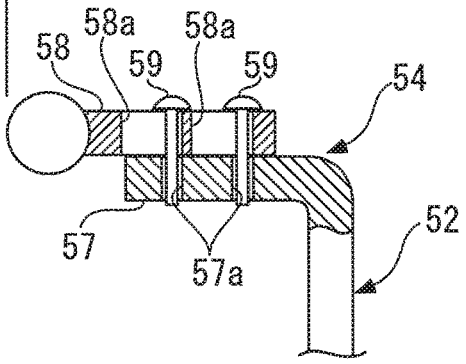

In the contact portion 54 of the pressing member 52, which is constructed as above, the contact portion body 58 can be moved relative to the support portion 57 in the front-rear direction over a distance corresponding to the length of the slot 58*a* by loosening the screws 59. FIGS. 6A and 6B show a state in which the contact portion body 58 is most forwardly positioned and a state in which the contact portion body 58 is most rearwardly positioned, respectively. As shown in FIGS. 6A and 6B, it is possible to adjust the contact portion body 58 in the front-rear direction by an amount corresponding to an adjustment width A. Thus, by moving the rear end of the contact portion 54 (contact portion body 58) in the front-rear direction to adjust the same, it is possible to bring the contact portion 54 of the pressing member 52 into appropriate contact with the rod lever 25*a*.

Note that the present invention is not limited to the above-described embodiment, but it can be practiced in various forms. For example, although in the above-described embodiment, the present invention is applied to the upright electronic piano 1 by way of example, this is not limitative, but it is to be understood that the present invention is also applicable to an acoustic piano. Further, although in the above-described second variation, the contact portion body 58 is configured to be movable on the support portion 57 of the contact portion 54 in the front-rear direction, a screw having a predetermined length, for example, may be used in place of the contact portion body 58 such that the screw is screwed into the rear end surface of the support portion 57 in a manner movable back and forth in the front-rear direction, and the head part of the screw is brought into contact with the rod lever 25*a*. Furthermore, the details of the construction of each of the electronic piano 1, the damper lever 21, the damper rod 25, the pedal rod 28, and the damper lever drive mechanisms 31, 41, and 51 are described only by way of example, and they can be changed as appropriate within the scope of the subject matter of the present invention.

What is claimed is:

1. An upright keyboard instrument in which a plurality of keys and actions associated with the respective keys are arranged side by side in a left-right direction, comprising:

a plurality of damper levers each of which extends in a vertical direction and is pivotally movably supported at or in the vicinity of a longitudinal center thereof, the damper levers being provided in association with the actions, respectively, and arranged side by side in the left-right direction at a location rearward of the actions;

a damper rod which extends in the left-right direction and is supported in a manner movable in a front-rear direction in a state brought into contact with lower portions of the respective damper levers from a front side;

a pedal rod which extends in the vertical direction and is disposed forward of the damper levers, the pedal rod being configured to be moved upward by depression of a pedal; and a damper lever drive mechanism which is provided between a longitudinal end of the damper rod and an upper end of the pedal rod and is configured to drive the lower portions of the respective damper levers such that the lower portions of the respective damper levers are pressed rearward by moving the damper rod rearward in accordance with upward movement of the pedal rod.

2. The upright keyboard instrument according to claim 1, wherein the damper rod is configured to be pivotally movable about a pivotal portion located thereabove between a standby position where the damper rod is positioned when the pedal is in a non-operated state and a pressing position for pressing the damper levers rearward, and has a rod lever provided at a longitudinal end thereof and extending downward over a predetermined length, and wherein the damper lever drive mechanism includes:

a pressing member which is in contact with a front surface of the rod lever and in engagement with the upper end of the pedal rod and is configured to press the rod lever rearward, and a pivotal movement support configured to pivotally support the pressing member.

3. The upright keyboard instrument according to claim 2, wherein the pressing member includes:

a contact portion which extends in the front-rear direction over a predetermined length and has a rear end thereof held in contact with the front surface of the rod lever, a pivotally movable portion which extends below the rod lever in the front-rear direction over a predetermined length, and has a front end thereof, which is located forward of the pivotal portion, held in engagement with the upper end of the pedal rod, and a rear end thereof, which is located rearward of the pivotal portion, supported by the pivotal movement support such that the pivotally movable portion is pivotally movable about an axis extending in the left-right direction, and a connection portion which connects between a front end of the contact portion and the front end of the pivotally movable portion.

4. The upright keyboard instrument according to claim 3, wherein the contact portion is configured such that the rear end thereof to be brought into contact with the rod lever is movable in the front-rear direction.

5. The upright keyboard instrument according to claim 4, wherein the contact portion includes:

a support portion which extends in the front-rear direction over a predetermined length and is continuous with the connection portion, and a contact portion body which extends in the front-rear direction over a predetermined length and is configured to be movable in the front-rear direction in a state placed on the support portion, the contact portion body being fixed to the support portion, in a state protruding rearward of the support portion.

* * * * *